US006347794B2

(12) United States Patent
Scrymgeour et al.

(10) Patent No.: US 6,347,794 B2
(45) **Date of Patent: *Feb. 19, 2002**

(54) COMBINATION INSTANT SCRATCH-OFF / BREAK-OPEN TICKET

(76) Inventors: Lyle Harold Scrymgeour, Box 9, Group 4, R.R.#1, Dugald, Manitoba (CA), R0E 0K0; Michael John Brickwood, 3 McMahon Place, Winnipeg, Manitoba (CA), R3W 1H1

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/406,689

(22) Filed: Sep. 27, 1999

(51) Int. Cl.[7] ..... A63F 1/00
(52) U.S. Cl. ..... 273/138.1; 273/139
(58) Field of Search ..... 273/138.1, 139; 283/901, 903

(56) References Cited

U.S. PATENT DOCUMENTS 4,174,857 A 11/1979 Koza
4,398,708 A * 8/1983 Goldman
5,125,689 A * 6/1992 Heninger
5,217,258 A * 6/1993 Sanderson
5,253,899 A 10/1993 Greenwood
5,255,456 A 10/1993 Franklin
5,414,262 A 5/1995 Filo
5,562,284 A 10/1996 Stevens
5,618,112 A 4/1997 Lovell
5,949,042 A * 9/1999 Dietz
6,145,885 A * 11/2000 Scrymgeour et al.

FOREIGN PATENT DOCUMENTS

WO WO 98/57715 12/1998

* cited by examiner

*Primary Examiner*—Benjamin H. Layno
*Assistant Examiner*—V K Mendiratta

(57) ABSTRACT

Described herein is a lottery ticket comprising a front surface having lottery indicia covered by a scratch-off layer printed thereon and a rear surface having a plurality of break-open windows for viewing the variable image printed lottery indicia beneath the windows. The ticket is one of a row of such tickets each connected to the next at a line of weakness allowing the tickets to be stacked in a dispenser in fan folded arrangement for dispensing. The game data is applied by variable imaging techniques allowing the use of fully variable games and validation bar codes.

19 Claims, 7 Drawing Sheets

COMBINATION INSTANT SCRATCH-OFF / BREAK-OPEN TICKET

This application is related to application, Ser. No. 09/406,690, filed Sep. 27, 1999 and now issued as U.S. Pat. No. 6,145,885.

The present invention relates generally to the field of lottery tickets.

BACKGROUND OF THE INVENTION

Lottery tickets are well known and widely sold and typically comprise a sheet material of paper or card stock on which is printed lottery information and various indicia for the playing of one or more games. Many such games are instant win type games where the player can play the game or games by carrying out various functions. These include a first type of ticket which involves removing a scratch-off layer for scratch-off tickets. A second type of ticket involves opening pull tabs windows for what are known as break-open tickets. Such tickets are also known variously as pull-tabs, pickle cards, jar tickets, hard cards and charitable gaming tickets. Typically, these two distinct types of lottery tickets are targeted to different markets.

The break-open ticket is typically manufactured in a process which involves firstly printing using a printing press a full sheet which thus defines a set of the tickets in rows and columns which is laminated to a similar sheet of top sheet portions. The laminated sheets then must be cut in a mechanical cutting station into the individual ticket portions. The tickets thus formed are limited to the symbol combinations printed in the set. Also bar codes which are individual to specific tickets cannot be included with this process since there are many identical tickets and the bar code is thus not unique. This leads generally to a reduced level of security for break-opens generally thus limiting the prize value which can be provided.

This technique also limits the flexibility of the construction and therefore break opens tend to be relatively simple.

As shown in published PCT International application No. WO 98/57715 published Dec. 23$^{rd}$ 1998 of the present applicants there is provided a pouched lottery ticket which is supplied in a fan folded continuous strip arrangement for separating each ticket from the next at a dispensing station. The disclosure of this publication is hereby incorporated herein by reference.

U.S. Pat. No. 4,174,857 (Koza) and U.S. Pat. No. 5,253,899 (Greenwood) each disclose a combined ticket construction in which a second layer is applied or folded over the basic ticket to improve security. U.S. Pat. No. 5,562,284 discloses a break-open ticket with a second level of break-open. U.S. Pat. No. 5,217,258 (Sanderson) discloses a two sided break-open ticket where the windows are arranged back to back opening onto a single center sheet carrying the game data.

SUMMARY OF THE INVENTION

It is one object of the present invention to provide an improved lottery ticket construction.

According to a first aspect of the invention, there is provided a lottery ticket assembly comprising:

a first ticket portion formed by a substantially flat substrate sheet material having a front surface having first lottery game indicia printed thereon, said lottery game indicia being covered with a scratch-off layer and a rear surface having second lottery game indicia printed thereon; and a second ticket portion formed by a substantially flat substrate sheet material having a rear surface and a front surface, the rear surface of the first ticket portion connected to the rear surface of the second ticket portion for forming the lottery ticket, said second ticket portion having at least one openable window therein arranged at a location aligned with the second lottery game indicia on the rear surface of the first ticket portion, such that opening of the openable windows allows the lottery indicia on the rear surface of the first ticket portion to be viewed.

Preferably the first and/or second lottery game indicia are applied by variable image printing.

Preferably the first and/or second lottery game indicia are applied by variable image printing onto a white lily pad.

Preferably the first and/or second lottery game indicia are applied by variable image printing using two or more colors.

Preferably the second lottery game indicia on the rear surface of the first ticket portion includes a bar code having a machine and/or human readable portion for validating the lottery ticket.

Preferably the first lottery game indicia on the front surface of the first ticket portion includes a bar code having a machine and/or human readable portion for validating the lottery ticket.

Preferably there is provided a row of the tickets, each having a row of perforations dividing each from the next for separation of the tickets for dispensing.

Preferably the lottery tickets are fan folded along each junction with the fold at the front edge of each lottery ticket being in a direction opposite to the fold at the rear edge of each lottery ticket so that the lottery tickets lie each on top of and parallel to the next.

According to a second aspect of the invention there is provided a method of preparing a lottery ticket comprising:

providing a first continuous substrate sheet material in a first strip having a front surface and a rear surface;

providing a second continuous substrate sheet material in a second strip having a front surface and a rear surface;

printing promotional graphics onto said front surface of each of the first and second strips;

printing first lottery game indicia onto said front surface of said first strip;

printing second lottery game indicia onto said rear surface of said first strip;

connecting the rear surface of the first strip to the rear surface of the second strip to form a row of connected tickets;

providing between each ticket and the next a line of weakness for separation of each ticket from the next;

and providing a plurality of openable windows on the second strip at each ticket for exposing the second lottery game indicia on the rear surface of the first strip Preferably the first and/or the second lottery game indicia are applied by variable image printing.

Preferably the first and/or second lottery game indicia are applied by variable image printing onto a white lily pad.

Preferably the first and/or second lottery game indicia are applied by variable image printing using two or more colors.

Preferably the sheet forming the first ticket portion and the sheet forming the second ticket portion have side edges and the first ticket portion and the second ticket portion are connected along said side edges.

Preferably the method includes connecting the sheet forming the first ticket portion and the sheet forming the second ticket portion with an adhesive.

Preferably the lottery tickets are fan folded along each junction with the fold at the front edge of each lottery ticket construction being in a direction opposite to the fold at the rear edge of each lottery ticket construction so that the lottery ticket constructions lie each on top of and parallel to the next.

BRIEF DESCRIPTION OF THE DRAWINGS

One embodiment of the invention will now be described in conjunction with the accompanying drawings in which.

In the drawings like characters of reference indicate corresponding parts in the different figures.

DESCRIPTION OF THE PREFERRED EMBODIMENTS

Figure 1:
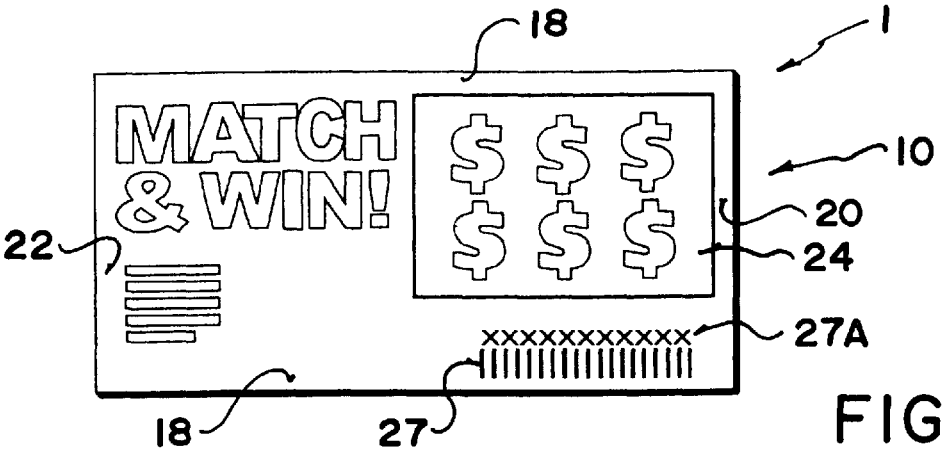
FIG. 1 is a front view of a first embodiment of combined ticket according to the present invention showing a front of the first ticket portion.
Figure 2:
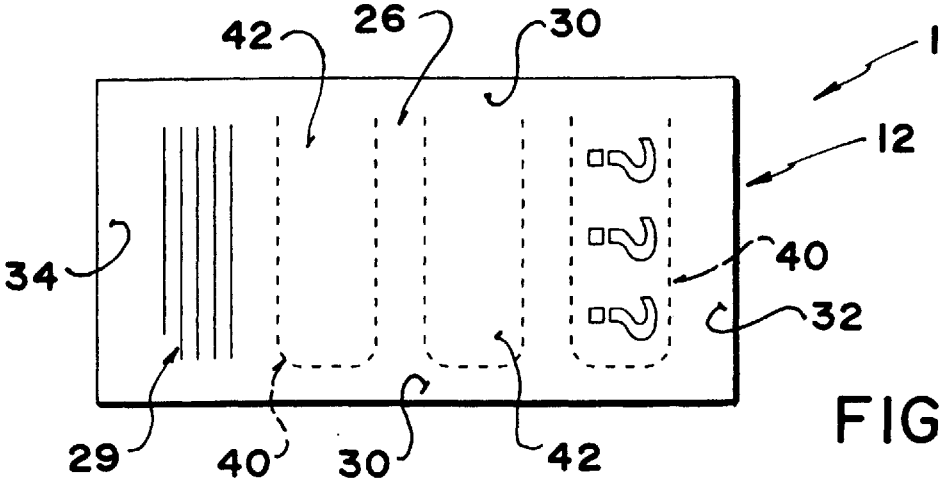
FIG. 2 is a rear view of the combined ticket of FIG. 1 showing the front of the second ticket portion.
Figure 3:
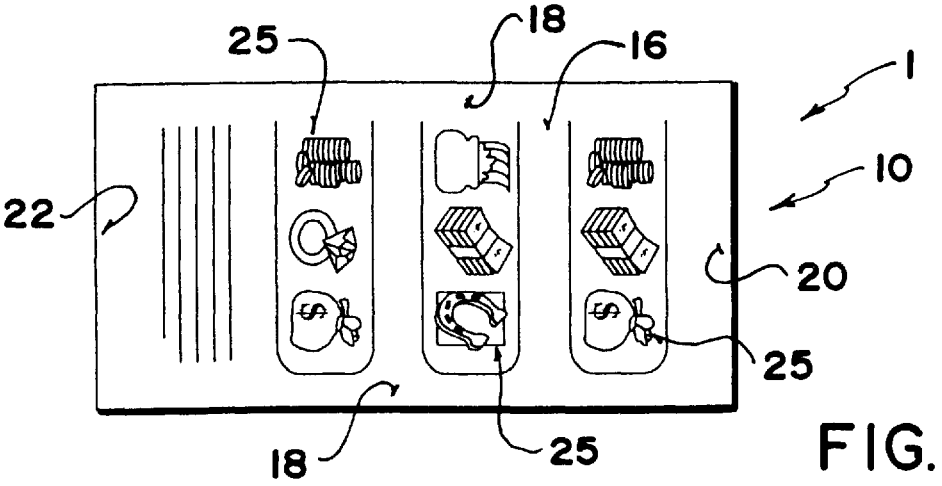
FIG. 3 is a rear view similar to that of FIG. 2 showing the front of the second ticket portion with the tabs opened to expose the indicia on the rear of the first ticket portion.
Figure 5:
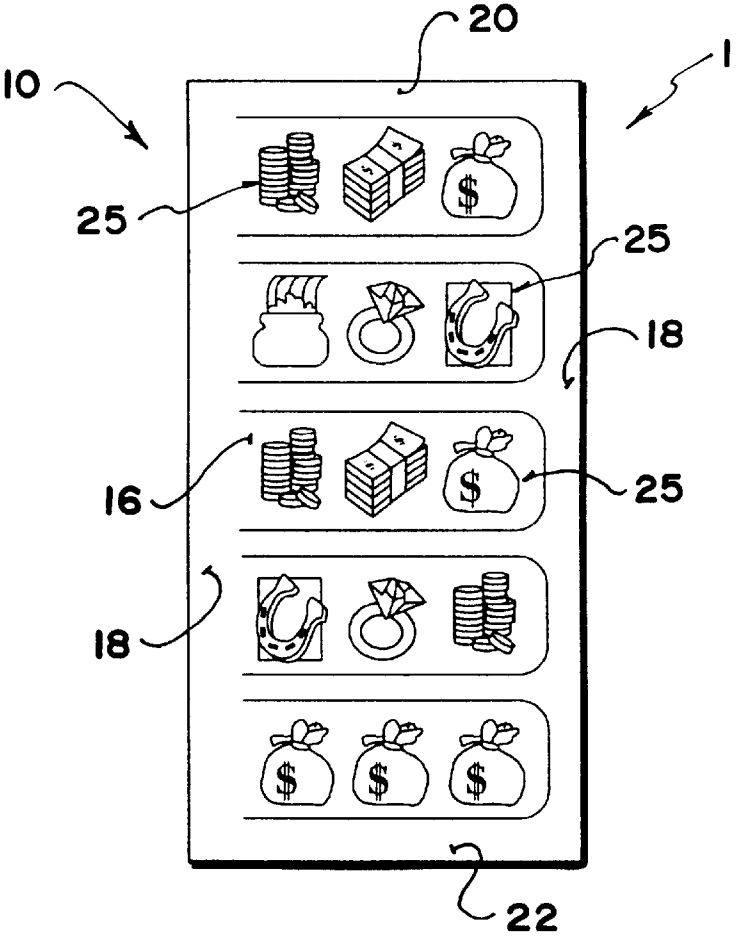
FIG. 5 is a rear view of the alternative embodiment of FIG. 4 showing the tabs opened to expose the indicia on the rear of the first ticket portion.
Figure 4:
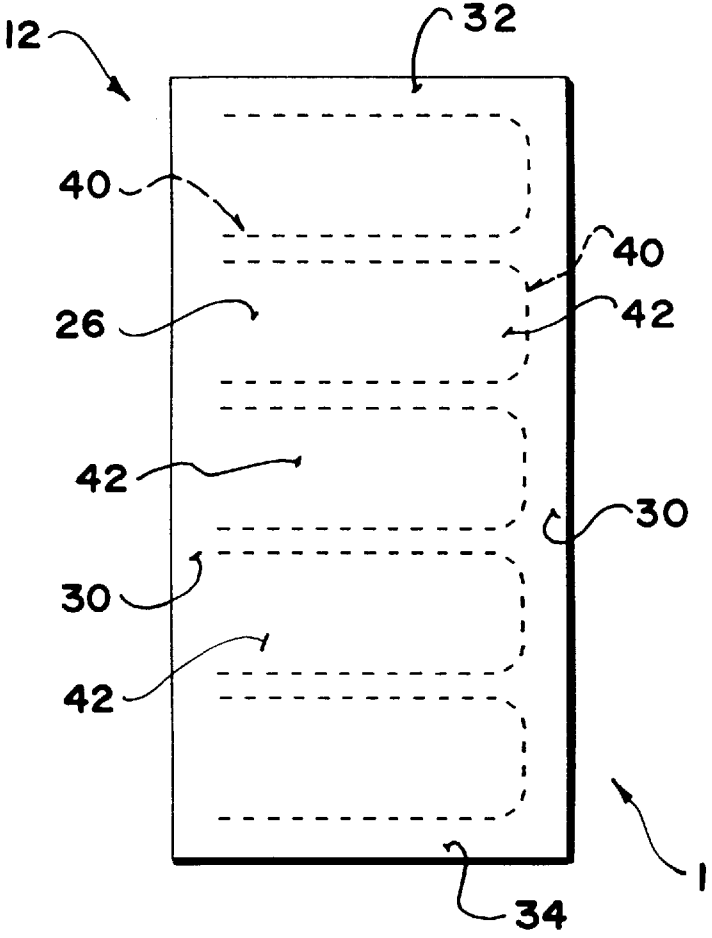
FIG. 4 is a rear view of an alternative embodiment of combined ticket according to the present invention.
Figure 7:
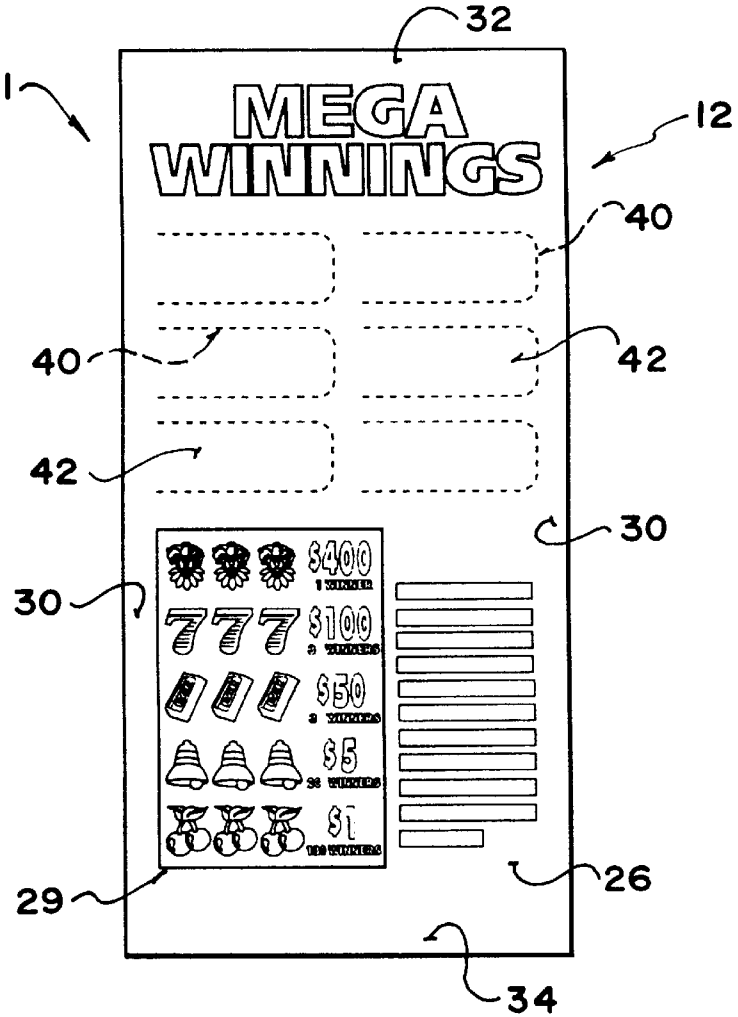
FIG. 7 is a rear view of the second alternative embodiment of the lottery ticket of FIG. 6.
Figure 6:
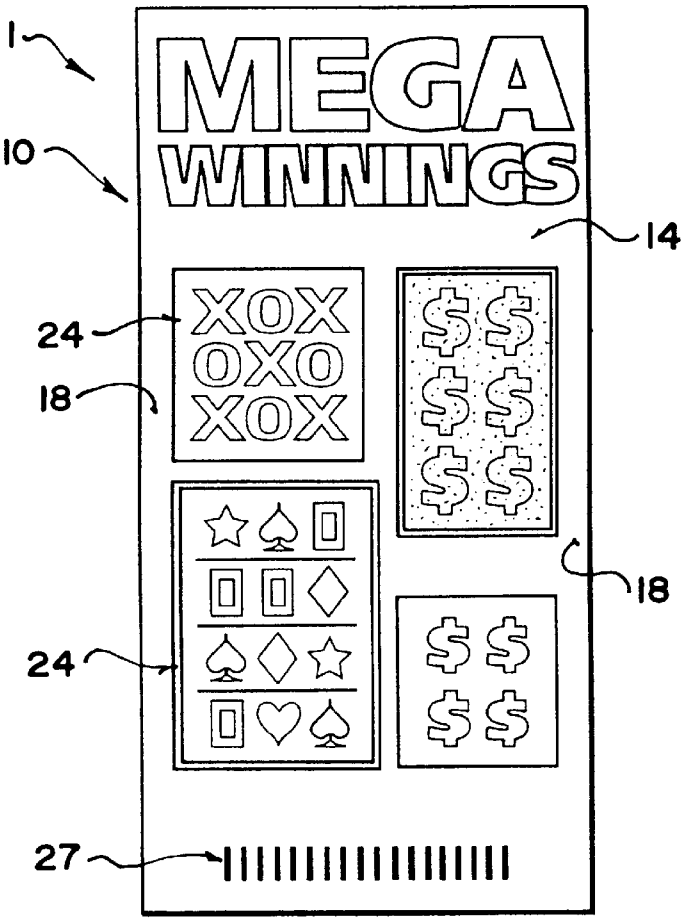
FIG. 6 is a front view of a second alternative embodiment of the lottery ticket.

Referring to the embodiment of FIGS. 1, 2 and 3, to the embodiment of FIGS. 4 and 5 and to the embodiment of FIGS. 6 and 7, each lottery ticket 1 comprises a first ticket portion 10 and a second ticket portion 12.

The first ticket portion 10 is formed by substantially flat substrate sheet material and has a front surface 14, a rear surface 16, side edges 18, a top edge 20 and a bottom edge 22. The front surface 14 has lottery indicia 24 printed thereon and at least some of the variable imaged lottery indicia are covered with a scratch-off layer, as shown in FIG. 1. That is, at least some of the lottery indicia are obscured with a scratch-off layer which is removed by the purchaser when "playing", as described below. The rear surface 16 has lottery indicia 25 variable image printed thereon, as shown in FIG. 3. The lottery indicia 24 may include a bar code 27 printed on the front surface 14 for identifying and redeeming the lottery ticket 1. A human readable portion of the bar code is indicated at 27A. Also a void if removed section for security, that is a machine and/or human readable code covered by a scratch-off layer marked "void if removed". Also the rear surface 16 may include a bar code printed under the break open tabs. Because the bar code is printed by variable image printing techniques, it is unique to the specific ticket and is not merely a number identifying particular winning indicia.

The second ticket portion 12 is formed by substantially flat substrate sheet material and has a front surface 26, a rear surface (not shown), side edges 30, a top edge 32 and a bottom edge 34, as shown in FIG. 2. In some embodiments, the front surface 26 has promotional graphics or lottery information 29 printed thereon.

The lottery ticket 1 is formed by connecting the rear surface 16 of the first ticket portion 10 to the rear surface of the second ticket portion 12. The rear surface 16 of the first ticket portion 10 is connected to the rear surface 28 of the second ticket portion 12 by an adhesive along all four side edges, thus fully enclosing the area between the two ticket portions. The rear surface of the first ticket portion 10 may include markings for aligning the second ticket portion 12 to the first ticket portion 10.

The front surface 26 of the second ticket portion 12 includes a plurality of line of weakness 40 arranged to lie opposite the lottery indicia 25 on the rear surface 16 of the first ticket portion 10, thereby forming a plurality of break-open windows 42 as shown in FIG. 2. The line of weakness 40 is introduced onto the front surface 26 of the second ticket portion 12 by die-cutting.

Shown in FIG. 2 is an embodiment wherein there are three break-open windows 42. An alternative embodiment is shown in FIGS. 4 and 5 which shows a lottery ticket 1 having five break-open windows 42. Similarly, an alternative embodiment is shown in FIGS. 6 and 7 wherein there are six break-open windows 42. As will be apparent to one knowledgeable in the art, the number and arrangement of break-open windows can be varied considerably.

In use, the user purchases a lottery ticket 1. The user "plays" the lottery ticket by removing the scratch-off layer covering the lottery indicia 24 on the front surface 14 of the first ticket portion 10 and opening the break-open windows 42 covering the lottery indicia 25 on the rear surface 16 of the first ticket portion 10. The user then consults the lottery information printed on the lottery ticket 1 to determine if the ticket is a winner. When the lottery ticket 1 is redeemed, the vendor uses the bar code 27 to determine if indeed the lottery ticket 1 is a winner.

Figure 8:
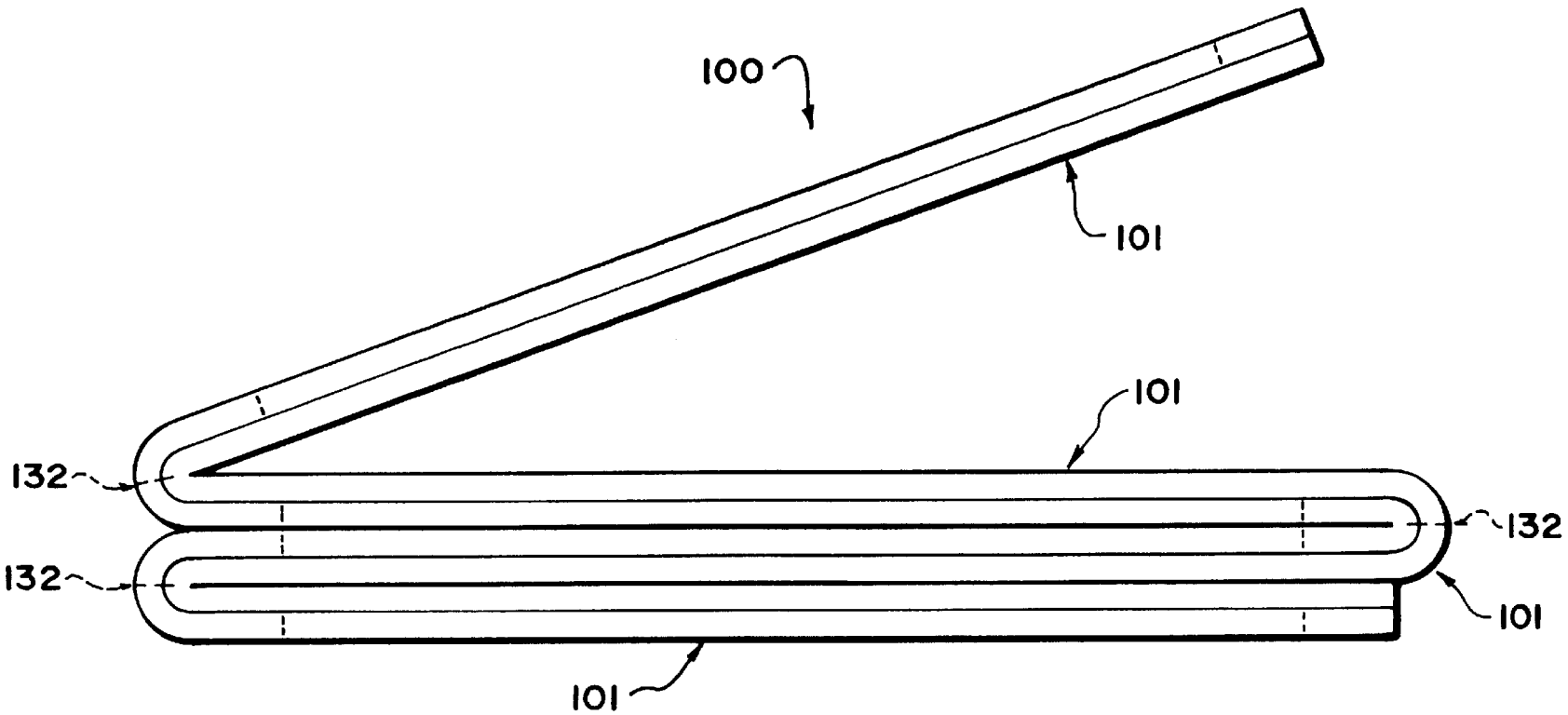
FIG. 8 is a side view of a lottery ticket construction including a strip of the tickets of FIG. 1.
Figure 9:
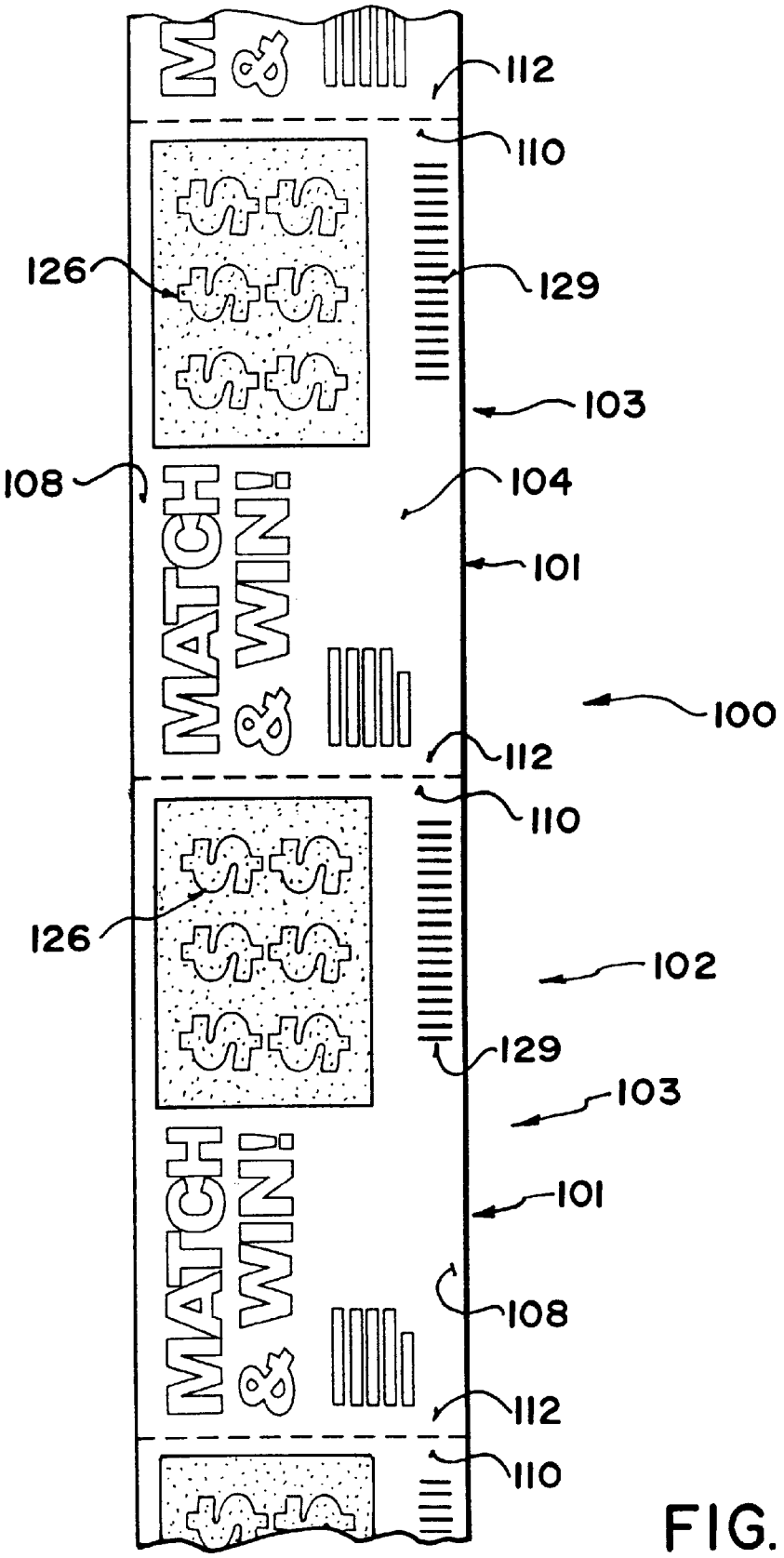
FIG. 9 is a front view of the strip of tickets of FIG. 1.
Figure 10:
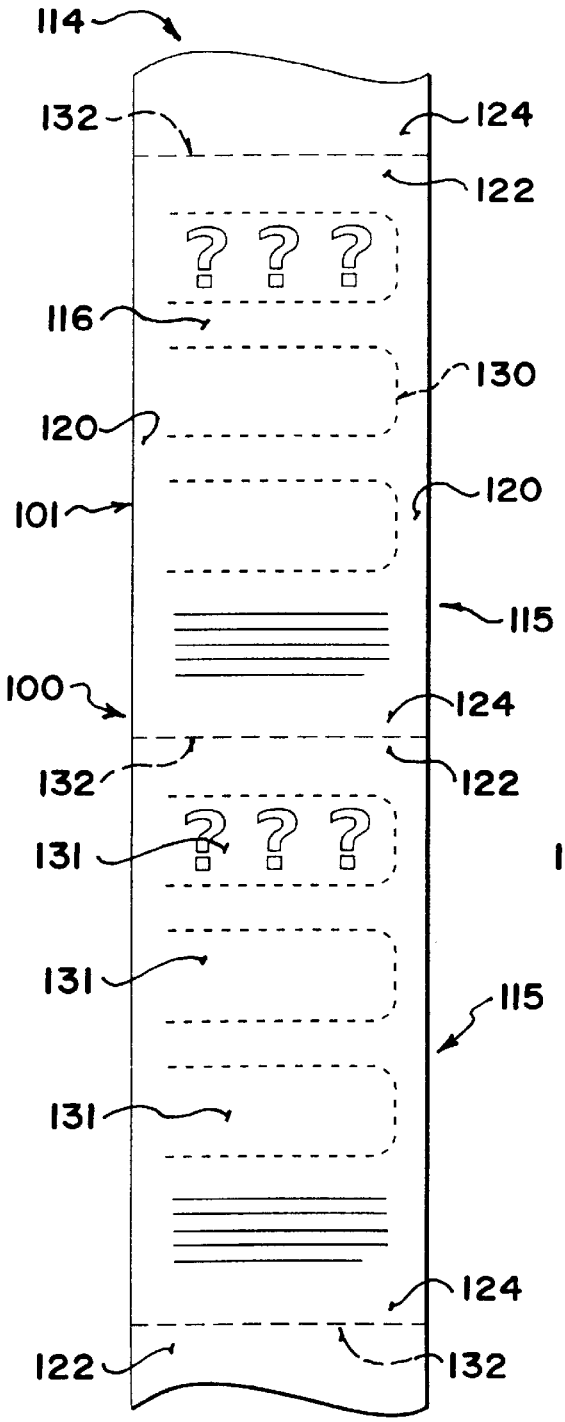
FIG. 10 is a rear view of the strip of tickets of FIG. 1.
Figure 11:
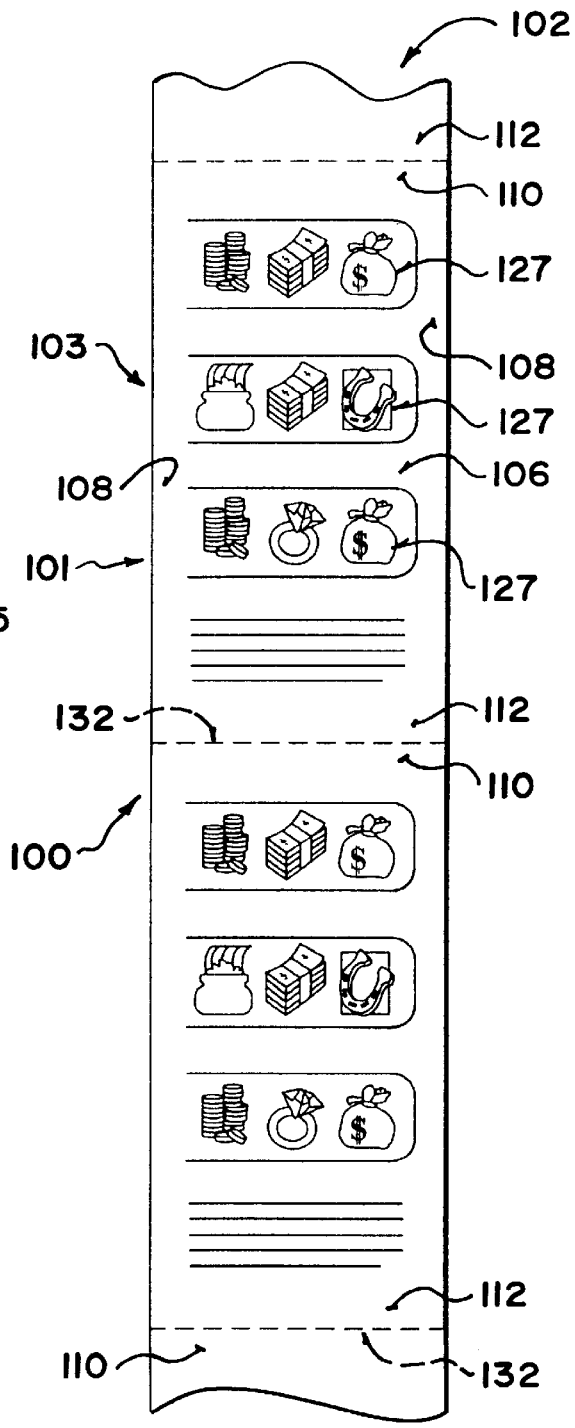
FIG. 11 is a rear view of the strip of tickets of FIG. 1 showing the tabs in the open position to expose the indicia on the rear of the first ticket portion.

Referring to FIGS. 8–11, a method of preparing a lottery ticket construction 100 comprised of a plurality of lottery tickets 101 comprises providing a first strip 102 composed of a plurality of first ticket portions 103 each composed of a substantially flat sheet material and having a front surface 104, a rear surface 106, side edges 108, a top 110 and a bottom 112 as shown in FIGS. 9 and 11 and providing a second strip 114 composed of a plurality of second ticket portions 115 each composed of a substantially flat sheet material and having a front surface 116, a rear surface (not shown), side edges 120, a top 122 and a bottom 124 as shown in FIG. 10. As shown in FIG. 11, a plurality of lottery indicia 127 are variable image printed at regular intervals on the rear surface 106 of the first strip 102 and a plurality of lottery indicia 126 are variable image printed on the front surface 104 of the first strip 102. Specifically, the plurality of lottery indicia 126, 127 are variable image printed onto the first strip 102 such that a representative one of the plurality of lottery indicia 126, 127 is between the top 110 and the bottom 112 of a representative one of the plurality of first ticket portions 103 respectively. It is of note that the lottery indicia 126,127 may include bar codes 129 for identification and redemption as well as void if removed areas for security. The bar codes may differ so that portions of the lottery ticket construction 100 can be redeemed separately, as described below. Furthermore, at least some of the lottery indicia 126 on the front surface 104 of the first strip 102 are covered with a scratch-off layer that obscures the lottery indicia and is removed by the user during play, as described above. Next, the rear surface 106 of the first strip 102 is placed in contact with the rear surface (not visible) of the second strip 114 and the first strip 102 and the second strip 114 are positioned relative to one another such that a representative one of the plurality of first ticket portions 103 is aligned with and opposite to a representative one of the plurality of second ticket portions 115. In some embodiments, the proper alignment of the first strip 102 to the second strip 114 may be confirmed manually. The second strip 114 is separated from the first strip 102 such that alignment is maintained and an adhesive is applied to the rear surfaces along the side edges 108, 120, the top edges 110, 122 and the bottom edges 112, 124, respectively. The rear surface 106 of the first strip 102 is then brought into contact with the rear surface of the second strip 114 and the first strip 102 is connected to the second strip 114. A plurality of lines of weakness 130 are then introduced into the front surface 116 of the plurality of second ticket portions 115 at regular intervals such that a respective one of the plurality of lines of weakness 130 extends around the lottery indicia 127 on the rear surface 106 of the first strip 102, thereby forming a plurality of break-out windows 131 for viewing the lottery indicia 127, as described below. The lines of weakness 130 may be introduced for example by die-cutting.

A plurality of rows of perforations 132 are then introduced into the lottery ticket construction 100 at junctions between the top of a representative one of the plurality of lottery tickets 101 and the bottom of an adjacent one of the plurality of lottery tickets 101, as shown in FIGS. 9–11. As a result of this arrangement, the plurality of lottery tickets 101 can be separated into individual lottery tickets by tearing along a representative one of the plurality of rows of perforations 132. The plurality of lottery tickets 101 are folded along each of the plurality of rows of perforations 132 with the fold at the front edge of each lottery ticket being in a direction opposite to the fold at the rear edge of each lottery ticket so that the lottery tickets lie each on top of and parallel to the next, as shown in FIG. 8.

Figure 12:
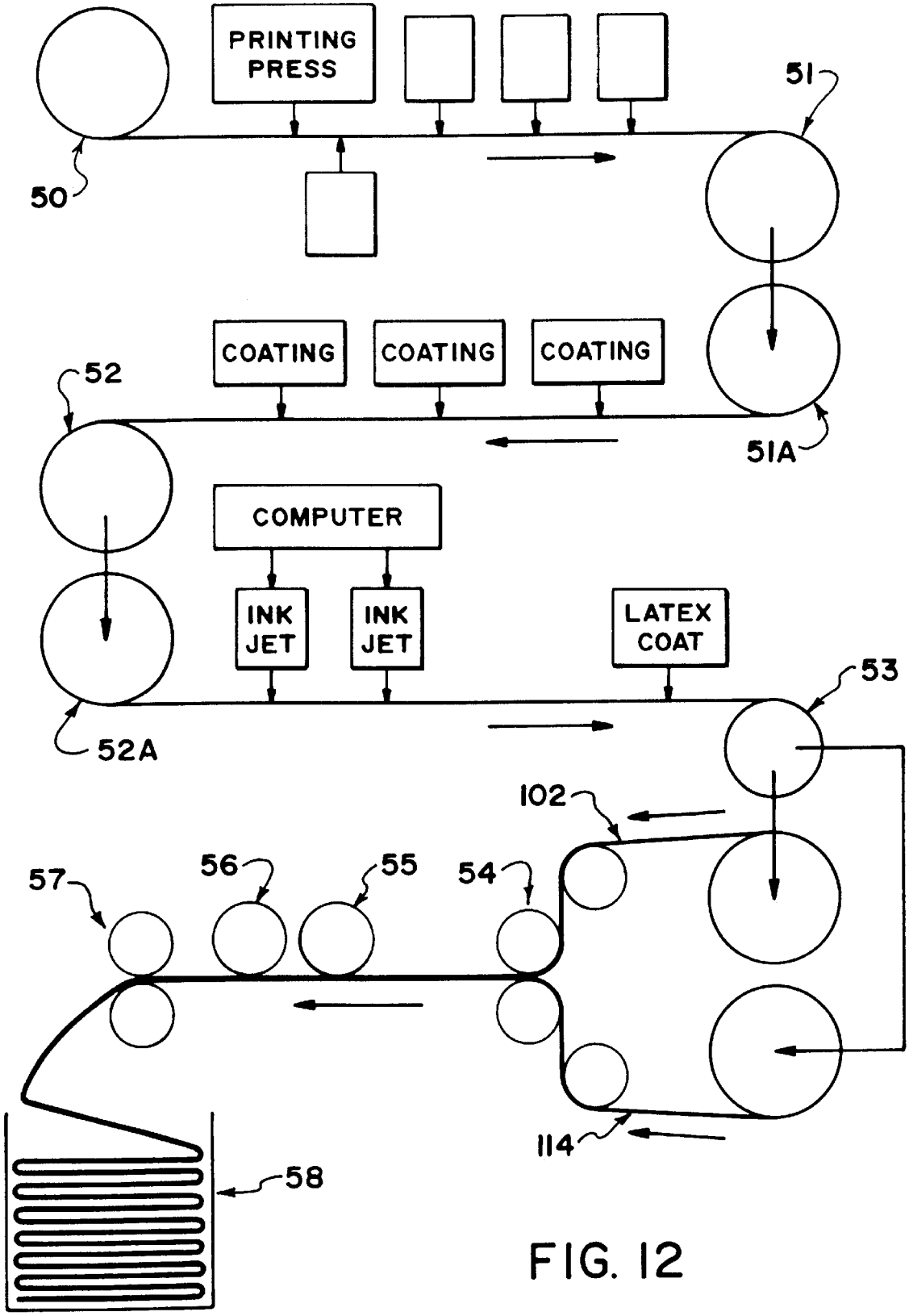
FIG. 12 is a schematic side elevational view of a process for forming the ticket assembly of FIG. 8.

In FIG. 12 is shown schematically the process described above. The process is shown in a number of discreet steps but it will be appreciated that the process can be integrated into a single continuous production line without the necessity for unrolling and re-rolling the strip in the separate steps as shown.

Thus in a first step of the process, an initial strip of blank paper stock is unrolled from a supply roll 50 and is rewound onto a rewind roll 51. As the strip is forwarded, graphics and base printing is applied onto the strip from a series of colour printing presses so as to provide preferably a full colour printing of both sides of the strip.

In the second step, the re-rolled roll is used as a supply as indicated at 51A and the strip passes through a coating station including a plurality of coating elements before being rewound at a rewind station 52. The coating elements provide a series of layers or lily pads over sections of the strip at which the lottery games are to be applied. This provides a security layer or coating for the strip which enhances security to prevent chemical, light or other attack onto the base paper stock to avoid improper examination of the tickets revealing the winning ticket without the necessity for scratching the scratch off layers. Various arrangements of security coating are known in the industry and thus this aspect is well known to one skilled in the art and further detail will not be described in detail herein.

The resultant or final layer of the security coating is generally a white lily pad so that the white layer does not interfere with or detract from the brightness of subsequent application of coloured printed materials or layers.

The re-rolled roll 52 is applied at a supply station 52A for a third step in the process where the strip is unrolled and re-rolled at a station 53. In the third step, the lottery indicia are applied to the white lily pad over the security layers previously described to provide the game data. The lottery indicia are applied by variable image printing techniques as opposed to use of fixed printing presses.

It will be appreciated that a printing press can apply only predetermined arrangements of characters which are set up in the printing press and cannot be readily or quickly varied. The variable image printing process to the contrary uses a computer controlled system to control conventional printing elements such as ink jet, bubble jet or laser so that the image applied can be varied to any particular requirement allowing each ticket to be entirely different from others. This technique can generate one color images, but more preferably two colors such as red and black or more color images. The use of variable image printing techniques allows also the following advantages:

It avoids the use of a limited number of combinations of symbols in the game data which is otherwise available by conventional printing press;

The prize parameters, that is the arrangement and numbers of winning tickets relative to losing tickets, can be tailored to suit particular circumstances, customers or games and is not limited to the fixed arrangements available with the conventional printing press;

As the strip is continuous and is not cut from a press printed sheet, there are no markings or patterning of the substrate caused by mechanically cutting substrate pieces from a larger printed sheet, thus avoiding the possibility that the markings or patterning could be used to locate and identify winning tickets.

The application of a bar code (including machine and/or human readable portions) which is unique to the ticket and is applied directly with and at the same time as the game indicia to allow identification and validation of individual tickets.

Subsequent to the application of the game data a coating device applies the latex scratch-off coating in one or more layers using conventional techniques and materials. The coated strip is then wound at a winding station 53. Although it is shown for convenience that the latex coating is in line with the imaging, this is generally not so and the two steps are carried out independently on different lines.

Strips thus formed with the graphics printing, security coatings, game data and scratch-off layers are thus formed and available at the station 53. One of these strips is then used in a lamination process at laminating and calendaring rolls 54 together with a strip taken from station 51 which has only graphics and base printing. The laminated strips are then passed through a die cut roller system 55 and a kiss cut roller system 56 to apply the lines of weakness and perforations as previously described. The strip is then folded back and forth in a fan folding arrangement 57 to form a fan folded stack 58 of the finished tickets in the ticket assembly.

The laminated tickets in the fan folded stack are also shown on larger scale in FIG. 8.

In use, the user purchases a lottery ticket and a representative one of the plurality of lottery tickets 101 is removed from the lottery ticket construction 100 either by a retailer manually dividing the required tickets or in a dispensing system in which the fan folded stack is stored by tearing along the row of perforations 132. The representative one of the plurality of lottery tickets 101 is now functionally identical to lottery ticket 1 described above and can be used in a similar manner as described above. The above referenced PCT Application provides further detail of the fan folded construction and the dispensing thereof. The plurality of lottery tickets 101 are fan folded and if desired the folds can be arranged along each of the plurality of rows of perforations 132 with the fold at the front edge of each lottery ticket being in a direction opposite to the fold at the rear edge of each lottery ticket so that the lottery tickets lie each on top of and parallel to the next. Alternatively, the folds can be spaced along a number of tickets so that for each strip between two folds contains more than one ticket for example five such tickets.

While the preferred embodiments of the invention have been described above, it will be recognized and understood that various modifications may be made therein, and the appended claims are intended to cover all such modifications which may fall within the spirit and scope of the invention.

What is claimed is:

1. A lottery ticket assembly comprising:

a first ticket portion formed by a substantially flat substrate sheet material having a front surface and a rear surface;

the front surface having first lottery game indicia printed thereon by variable image printing, said first lottery game indicia defining a first game to be played by a player and at least some of the first lottery game indicia being covered with a scratch-off layer arranged to be removable by the player to expose the first lottery game indicia in playing the first game;

the rear surface having second lottery game indicia printed thereon by variable image printing, said second lottery game indicia defining a second game to be played by the player, and a second ticket portion formed by a substantially flat substrate sheet material having a rear surface and a front surface, promotional graphics on said front surface of each of the first and second ticket portions;

the rear surface of the first ticket portion being connected to the rear surface of the second ticket portion, said second ticket portion having at least one openable window therein arranged at a location aligned with the second lottery game indicia on the rear surface of the first ticket portion, such that opening of the at least one openable window by the player allows the second lottery game indicia on the rear surface of the first ticket portion to be viewed and the second game player by the player.

2. The lottery ticket assembly according to claim 1 wherein the first lottery game indicia are printed onto a white lily pad on the front surface of the first ticket portion.

3. The lottery ticket assembly according to claim 1 wherein the first lottery game indicia are printed using two or more colors.

4. The lottery ticket assembly according to claim 1 wherein the first lottery game indicia on the front surface of the first ticket portion include a first bar code having a machine readable portion for validating the lottery ticket and wherein the second lottery game indicia on the rear surface of the first ticket portion include a second bar code having a machine readable portion for validating the lottery ticket.

5. The lottery ticket assembly according to claim 1 wherein the second lottery game indicia are printed onto a white lily pad on the rear surface of the first ticket portion.

6. The lottery ticket assembly according to claim 1 wherein the second lottery game indicia are printed using two or more colors.

7. A lottery ticket construction comprising:

a plurality of lottery ticket assemblies each comprising:

a first ticket portion formed by a substantially flat substrate sheet material having a front surface and a rear surface;

the front surface having first lottery game indicia printed thereon by variable image printing, said first lottery game indicia defining a first game to be played by a player and at least some of the first lottery game indicia being covered with a scratch-off layer arranged to be removable by the player to expose the first lottery game indicia in playing the first game;

the rear surface having second lottery game indicia printed thereon by variable image printing, said second lottery game indicia defining a second game to be played by the player; and a second ticket portion formed by a substantially flat substrate sheet material having a rear surface and a front surface, promotional graphics on said front surface of each of the first and second ticket portions;

the rear surface of the first ticket portion being connected to the rear surface of the second ticket portion, said second ticket portion having at least one openable window therein arranged at a location aligned with the second lottery game indicia on the rear surface of the first ticket portion, such that opening of the at least one openable window by the player allows the second lottery game on the rear surface of the first ticket portion to be viewed and the second game played by the player;

wherein the lottery ticket assemblies are connected each to the next to form a continuous row of the ticket assemblies; and wherein the lottery ticket assemblies each have a transverse row of perforations dividing each from the next for separation by tearing of the tickets for dispensing.

8. The lottery ticket construction according to claim 7 wherein the lottery ticket assemblies are fan folded with a fold at a front edge of a lottery ticket assembly being in a direction opposite to a fold at a rear edge of a lottery ticket assembly so that the lottery tickets assemblies lie on top of and parallel to one another for dispensing.

9. The lottery ticket construction according to claim 7 wherein the first lottery game indicia are printed onto a white lily pad on the front surface of the first ticket portion.

10. The lottery ticket construction according to claim 7 wherein the first lottery game indicia are printed using two or more colors.

11. The lottery ticket construction according to claim 7 wherein the second lottery game indicia on the rear surface of the first ticket portion include a first bar code having a machine readable portion for validating the lottery ticket and wherein the first lottery game indicia on the front surface of the first ticket portion include a second bar code having a machine readable portion for validating the lottery ticket.

12. The lottery ticket construction according to claim 7 wherein the second lottery game indicia are printed onto a white lily pad on the rear surface of the first ticket portion.

13. The lottery ticket construction according to claim 7 wherein the second lottery game indicia are printed using two or more colors.

14. A lottery ticket construction comprising:

a first continuous substrate sheet material in a first strip having a front surface and a rear surface;

a second continuous substrate sheet material in a second strip having a front surface and a rear surface;

promotional graphics on said front surface of each of the first and second strips;

lottery game indicia printed by variable image printing onto said rear surface of said first strip;

the rear surface of the first strip being connected to the rear surface of the second strip to form a row of connected tickets;

a line of weakness between each ticket and the next for separation of each ticket from the next;

a plurality of openable windows on the second strip so that each ticket has at least one window for exposing the second lottery game indicia on the rear surface of the first strip;

the front surface of the first strip having additional lottery game indicia printed thereon by variable image printing, said additional lottery game indicia defining an additional game to be played by a player and at least some of the additional lottery game indicia being covered with a scratch-off layer arranged to be removable by the player to expose the additional lottery game indicia in playing the additional game.

15. The lottery ticket construction according to claim 14 wherein the first lottery game indicia are printed onto a white lily pad on the front surface of the first strip.

16. The lottery ticket construction according to claim 14 wherein the first lottery game indicia are printed using two or more colors.

17. The lottery ticket construction according to claim 14 wherein the first lottery game indicia on the rear surface of the first strip include a first bar code having a machine readable portion for validating the lottery ticket and wherein the second lottery game indicia on the rear surface of the first strip include a second bar code having a machine readable portion for validating the lottery ticket.

18. The lottery ticket construction according to claim 14 wherein the second lottery game indicia are printed onto a white lily pad on the rear surface of the first strip.

19. The lottery ticket construction according to claim 14 wherein the second lottery game indicia are printed using two or more colors.

* * * * *

UNITED STATES PATENT AND TRADEMARK OFFICE

CERTIFICATE OF CORRECTION

PATENT NO. : 6,347,794 B2 
DATED : February 19, 2002
INVENTOR(S) : Lyle Harold Scrymgeour and Michael John Brickwood It is certified that error appears in the above-identified patent and that said Letters Patent is hereby corrected as shown below:

Title page,
Item [73], should read:
-- [73] Assignee: Pollard Banknote Limited (CA) --

Signed and Sealed this

Twenty-sixth Day of November, 2002

*Attest:*

*Attesting Officer*

JAMES E. ROGAN
*Director of the United States Patent and Trademark Office*